US006838422B2

(12) United States Patent
Man et al.

(10) Patent No.: US 6,838,422 B2
(45) Date of Patent: Jan. 4, 2005

(54) PLASTICS COMPATIBLE DETERGENT COMPOSITION AND METHOD OF CLEANING PLASTICS

(75) Inventors: Victor F. Man, St. Paul, MN (US); Karen G. Klaers, Inver Grove Heights, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 10/108,234

(22) Filed: Mar. 26, 2002

(65) Prior Publication Data

US 2003/0083216 A1 May 1, 2003

Related U.S. Application Data

(63) Continuation of application No. 09/631,757, filed on Aug. 3, 2000, now Pat. No. 6,362,149.

(51) Int. Cl.[7] ..... C11D 17/00

(52) U.S. Cl. ..... 510/243; 510/189; 510/422; 510/426; 510/470; 510/460; 510/511; 510/504; 510/505; 510/506

(58) Field of Search ..... 510/218, 243, 510/189, 422, 426, 470, 460, 511, 504, 505, 506

(56) References Cited

U.S. PATENT DOCUMENTS

| | | | |
|---|---|---|---|
| 4,505,836 | A | 3/1985 | Fairchild |
| 5,003,057 | A | 3/1991 | McCurry et al. |
| 5,290,470 | A | 3/1994 | Dutcher |
| 5,366,654 | A | 11/1994 | Van Den Brom et al. |
| 5,501,815 | A | 3/1996 | Man |
| 5,663,133 | A | 9/1997 | Goldstein |
| 5,807,438 | A | 9/1998 | Lansbergen et al. |
| 5,824,163 | A | 10/1998 | Murphy |
| 5,846,339 | A | 12/1998 | Masshoff et al. |
| 6,060,444 | A | 5/2000 | Schulz et al. |
| 6,164,296 | A | 12/2000 | Lentsch et al. |
| 6,362,149 | B1 | 3/2002 | Man et al. |

FOREIGN PATENT DOCUMENTS

| | | |
|---|---|---|
| CA | 941705 | 2/1974 |
| EP | 282214 A | 9/1988 |
| EP | 844301 A2 | 5/1998 |
| EP | 0 875 556 A2 | 11/1998 |
| JP | 03070799 | 3/1991 |
| JP | 03079700 | 4/1991 |
| JP | 06049497 | 2/1994 |
| JP | 06049498 | 2/1994 |
| JP | 07118689 | 5/1995 |
| JP | 08239691 | 9/1996 |
| JP | 08253797 | 10/1996 |
| JP | 09157635 | 6/1997 |
| JP | 11100600 | 4/1999 |

*Primary Examiner*—Necholus Ogden
(74) *Attorney, Agent, or Firm*—Merchant & Gould P.C.

(57) ABSTRACT

A plastics compatible detergent composition is provided by the invention. The plastics compatible detergent composition includes about 0.01 wt. % to about 10 wt. % anionic surfactant; about 0.01 wt. % to about 10 wt. % cationic surfactant; about 0.01 wt. % to about 10 wt. % of at least one of reverse polyoxyalkylene block copolymer surfactant, alcohol alkoxylate surfactant having polyoxypropylene and/or polyoxybutylene end groups, and mixtures thereof; about 0.01 wt. % to about 10 wt. % alkylpolyglycoside surfactant; and about 0.01 wt. % to about 20 wt. % silicone surfactant. A method for washing an article having a plastic surface is provided by the invention. The method includes a step of applying the detergent composition to the plastic surface, and rinsing the detergent composition from the article.

23 Claims, No Drawings

PLASTICS COMPATIBLE DETERGENT COMPOSITION AND METHOD OF CLEANING PLASTICS

This is a continuation of U.S. Ser. No. 09/631,757 filed Aug. 3, 2000, now U.S. Pat. No. 6,362,149.

FIELD OF THE INVENTION

The invention relates to a plastics compatible detergent composition and to a method for cleaning plastics. In particular, the plastics compatible detergent composition is a detergent composition that can be used in a conventional warewashing machine.

BACKGROUND OF THE INVENTION

Many articles manufactured from plastics require periodic cleaning. Many conventional detergent compositions include chemicals that cause stress cracks in plastics. Stress cracks are the cracks that result when the plastic is exposed to chemicals (usually organic) that facilitate the release of the built-in stress (or frozen-in stress) in the plastics.

U.S. Pat. No. 5,501,815 to Man discloses a plasticware-compatible low-foaming rinse aid composition. The rinse aid composition includes an alkyl polyglycoside (APG) and a reverse polyoxyethylene-containing polyoxyalkylene block copolymer.

SUMMARY OF THE INVENTION

A plastics compatible detergent composition is provided by the invention. The plastics compatible detergent composition includes about 0.01 wt. % to about 10 wt. % anionic surfactant; about 0.01 wt. % to about 10 wt. % cationic surfactant; about 0.01 wt. % to about 10 wt. % at least one of reverse polyoxyalkylene block copolymer surfactant, alcohol alkoxylate surfactant having polyoxypropylene and/or polyoxybutylene end groups, and mixtures thereof; about 0.01 wt. % to about 10 wt. % alkylpolyglycoside surfactant; and about 0.01 wt. % to about 20 wt. % silicone surfactant.

A method for washing an article having a plastic surface is provided by the invention. The method includes a step of applying the detergent composition to the plastic surface, and rinsing the detergent composition from the article.

DETAILED DESCRIPTION OF THE INVENTION

A plastics compatible detergent composition is provided for cleaning articles manufactured from plastics. It should be understood that the term "plastics compatible" reflects the relative compatibility of the detergent composition according to the invention with certain types of plastics compared with prior art detergent compositions that have a tendency to develop stress cracking in plastics over time. The plastics compatible detergent composition according to the invention provides reduced stress cracking when used to clean plastics compared with certain prior art detergent compositions. Types of plastics that can be cleaned with the plastics compatible detergent composition according to the invention include those polymers that have a tendency to develop stress cracking when cleaned with conventional detergents, such as, polycarbonate polymers (PC), acrilonitrile-butadiene-styrene polymers (ABS), and polysulfone polymers (PS).

Articles that can be cleaned with the plastics compatible detergent composition according to the invention are preferably articles that are manufactured from polymers that have a tendency to develop stress cracking when cleaned with conventional detergents and that generally require periodic cleaning. Exemplary articles include head protection gear, playground equipment, toys, safety windows or shields, and self-contained breathing equipment. Exemplary head protection gear includes safety helmets, sports helmets, hard hats, and safety glasses. Exemplary playground equipment includes indoor and outdoor playground equipment. In particular, certain fast food chains have polymeric indoor playground equipment that requires periodic cleaning. Exemplary safety shields include shields for helmets and masks that are used by policemen and firefighters, and in the laboratory. In addition, articles which can be cleaned include those articles having desired optical clarity including, for example, windows, bullet proof windows, safety glasses, safety shields, and underwater masks.

Types of soil that can be cleaned from articles according to the invention include those types of soils that are commonly encountered on the articles to be cleaned. Common types of soil that can be cleaned according to the invention include grease soils, carbon particulate soils, body fluid soils, and sand and/or dirt soils. An exemplary grease soil includes oil lubricant. Exemplary carbon particulate soils include soils resulting from welding and/or from fires. Exemplary body fluid soils include sweat, perspiration, and urine. It should be appreciated that a component that is intended to be present on the article surface, such as paint, is generally not considered to be soil.

The plastics compatible detergent composition according to the invention can be referred to more simply herein as the detergent composition. The detergent composition preferably includes a mixture of surfactants that tend not to cause stress cracking in plastics. The detergent composition can be used to clean articles in a conventional warewashing machine. When the detergent composition is used in a conventional warewashing machine, it is generally desirable that the detergent composition exhibits sufficiently low foaming properties so that the detergent composition can be used in a conventional warewashing machine. The detergent composition can exhibit a level of foaming which renders it unsuitable for use in a conventional warewashing machine when the detergent composition is intended to be used in an environment where foaming is not a particular concern. For example, when the detergent composition is used to wash playground equipment, it is expected that the detergent composition can exhibit a relatively high level of foaming. The detergent composition preferably includes a mixture of at least two or more of alkyl polyglycoside surfactants, reverse polyoxyalkylene copolymer surfactants, cationic surfactants, polysiloxane surfactants, and anionic surfactants.

Alkyl Polyglycoside (APG) Surfactants

The alkyl polyglycosides (APGs), also called alkyl polyglucosides if the saccharide moiety is glucose, are naturally derived, nonionic surfactants. The alkyl polyglycosides that can be used in the present invention are fatty ester derivatives of saccharides or polysaccharides that are formed when a carbohydrate is reacted under acidic condition with a fatty alcohol through condensation polymerization. The APGs commonly are derived from corn-based carbohydrates and fatty alcohols from natural oils in animals, coconuts and palm kernels. Such methods for deriving APGs are known in the art. For example, see U.S. Pat. No. 5,003,057 to McCurry. The description in U.S. Pat. No. 5,003,057 relating the methods of making APGs and the chemical properties of APGs is incorporated by reference herein.

The alkyl polyglycosides that can be used in the present invention contain a hydrophilic group derived from carbohydrates and is composed of one or more anhydroglucose. Each of the glucose units can have two ether oxygens and three hydroxyl groups and a terminal hydroxyl group, imparting water solubility to the glycoside. The presence of the alkyl carbons leads to the hydrophobic activity. When carbohydrate molecules react with fatty alcohol molecules, alkyl polyglycosides molecules are formed with single or multiple anhydroglucose units, which are termed monoglycosides and polyglycosides, respectively. The final alkyl polyglycoside product typically has a distribution of varying concentration of glucose units (or degree of polymerization).

The APG that can be used in the detergent composition of the invention preferably comprises saccharide or polysaccharide groups (i.e., mono-, di-, tri-, etc. saccharides) of hexose or pentose, and a fatty aliphatic group having 6 to 20 carbon atoms. Preferred alkyl polyglycosides that can be used according to the present invention are represented by the general formula:

$$G_x—O—R \qquad \text{I}$$

wherein G is a moiety derived from reducing saccharide containing 5 or 6 carbon atoms, e.g., pentose or hexose; R is fatty aliphatic group containing 6 to 20 carbon atoms; and x is the degree of polymerization (D.P.) of the polyglycoside, representing the number of monosaccharide repeating units in the polyglycoside. Generally, x is an integer on the basis of individual molecules, but because there are statistical variations in the manufacturing process of the APG, x may be a noninteger on an average basis when referred to APG used as an ingredient for the detergent composition of the present invention. In this invention, x preferably has a value of less than 2.5, and more preferably is within the range between 1 and 2.

Exemplary saccharides from which G can be derived are glucose, fructose, mannose, galactose, talose, gulose, allose, altrose, idose, arabinose, xylose, lyxose and ribose. Because of the ready availability of glucose, glucose is preferred in the making of polyglycosides. The fatty aliphatic group, which is the substituent of the preferred polyglycoside, is preferably saturated, although unsaturated fatty group may be used.

Generally, commercially available polyglycosides have alkyl chains of $C_8$ to $C_{16}$ and average degree of polymerization of 1.4 to 1.6. In this invention, specific alkyl polyglycosides will be described as illustrated in the following way: "$C_{12-16}$ G 1.4" denotes a polyglycoside with an alkyl chain of 12 to 16 carbon atoms and an average degree of polymerization of 1.4 anhydroglucose units in the alkyl polyglycoside molecule. Commercially, alkyl polyglycoside can be provided as concentrate, aqueous solutions ranging from 50 to 70 wt-% active. Examples of commercial suppliers of alkyl polyglycosides are Henkel Corp. and Union Carbide Corp. Table 1 shows examples of commercially available (from Henkel Corp.) alkyl polyglycosides that can be used according to the present invention. The number of carbons in the alkyl groups and the average degree of polymerization in the APGs are also shown in Table 1. The average degree of polymerization of saccharides in the APG listed varies from 1.4 to 1.7 and the chain lengths of the aliphatic groups are between $C_{8-10}$ and $C_{12-16}$.

The detergent composition of the present invention has the advantage of having less adverse impact on the environment than conventional detergent compositions. Alkyl polyglycosides used in the present invention exhibit low oral and dermal toxicity and irritation on mammalian tissues. These alkyl polyglycosides are also biodegradable in both anaerobic and aerobic conditions and they exhibit low toxicity to plants, thus improving the environmental compatibility of the rinse aid of the present invention. Because of the carbohydrate property and the excellent water solubility characteristics, alkyl polyglycosides are compatible in high caustic and builder formulations.

TABLE 1

Examples of alkyl polyglycosides (Henkel Corp.)

| Alkyl polyglycoside | Henkel Surfactant | Ratio of APGs with Various Chain Lengths |
|---|---|---|
| $C_{8-10}$ G 1.7 | APG 225 | $C_8$:$C_{10}$ (45:55) |
| $C_{9-11}$ G 1.4 | APG 300 | $C_9$:$C_{10}$:$C_{11}$ (20:40:40) |
| $C_{9-11}$ G 1.6 | APG 325 | $C_9$:$C_{10}$:$C_{11}$ (20:40:40) |
| $C_{12-16}$ G 1.4 | APG 600 | $C_{12}$:$C_{14}$:$C_{16}$ (68:26:6) |
| $C_{12-16}$ G 1.6 | APG 625 | $C_{12}$:$C_{14}$:$C_{16}$ (68:26:6) |

In Table 1, the "Ratio of APGs with Various Chain Lengths" is the ratio by weight of the amount of APG of two different alkyl chain lengths in the commercially available APG sample. For example, $C_8$:$C_{10}$ (45:55) means about 45% of the APGs in the sample have alkyl chain length of 8 carbon atom and about 55% of the APGs in the sample have alkyl chain length of 10 carbon atoms. The APGs listed in Table 1 have moderate sheeting characteristics and are chemically compatible with thermoplastics such as polycarbonate and polysulfone. Because of the normal tendency of APGs to be foamy, defoamers such as long-chain ketone defoamers can be used with APGs.

The detergent composition preferably includes a sufficient amount of alkyl polyglycoside surfactant in an amount that provides a desired level of cleaning. When the detergent composition is intended to be used in a warewashing machine, the amount of alkyl polyglycoside surfactant should not be too much so that the detergent composition provides an unacceptable level of foaming so that the warewashing machine cannot adequately handle the detergent composition. Preferably, the detergent composition concentrate includes between about 0.01 wt. % and about 10 wt. % alkyl polyglycoside surfactant; more preferably between 0.1 and 3 wt. % alkyl polyglycoside surfactant; and, even more preferably, between about 0.1 and 0.6 wt. % alkyl polyglycoside surfactant.

Reverse Polyoxyalkylene Copolymer Surfactants

The reverse polyoxyalkylene copolymers, especially —$(EO)_e$—$(PO)_p$ block copolymers, are effective in reducing or minimizing the normal foaming activity or characteristic of APGs, which is quite foam-forming by itself. Unlike many defoamers, the reverse polyoxyalkylene block copolymer is capable of enhancing the sheeting characteristics of the aqueous rinse solution. It has been found that regarding chemical attack on thermoplastics, such as polycarbonate and polysulfone, the reverse polyoxyalkylene block copolymers have better thermoplastic compatibility than the normal-type polyoxyalkylene block copolymers, which have end blocks of —$(EO)_e$ in the polyoxyalkylene block copolymer chain. Because of their better water-solubility characteristics, the reverse polyoxyethylene-polyoxypropylene (i.e., reverse —$(EO)_e$—$(PO)_p$) block copolymers are preferred over other reverse polyoxyalkylene block copolymers, such as those that contain polyoxybutylene blocks.

The polyoxyalkylene block copolymers that can be used according to the present invention can be formed by reacting alkylene oxides with initiators. Preferably, the initiator is multifunctional if its use results in "multibranch" or "multiarm" block copolymers. For example, propylene glycol (bifunctional), triethanol amine (trifunctional), and ethylenediamine (tetrafunctional) can be used as initiators to initiate polymerization of ethylene oxide and propylene oxide to produce reverse block copolymers with two branches (i.e., arms or linear units of polyoxyalkylenes), three branches, and four branches, respectively. Such initiators may contain carbon, nitrogen, or other atoms to which arms or branches, such as blocks of polyoxyethylene $(EO)_e$, polyoxypropylene $(PO)_p$, polyoxybutylene $(BO)_b$, $—(EO)_e—(PO)_p$, $—(EO)_e—(BO)_b$, or $—(EO)_3—(PO)_p—(BO)_b$, can be attached. In such a copolymer, a larger amount of $(EO)_e$ results in higher water-solubility and a larger amount of $(PO)_p$ or $(BO)_b$ improves the thermoplastic compatibility of the copolymer. The amount of $(EO)_e$, $(PO)_p$, and $(BO)_b$ in the block copolymer can be selected such that the reverse block copolymer is detersive.

The reverse block copolymer surfactants which can be used according to the invention preferably include arms or chains of polyoxyalkylenes that are attached to the residues of the initiators and contain end blocks of $—(EO)_x—(PO)_y$, which have ends of polyoxypropylene (i.e., $—(PO)_y$), wherein x is about 1 to 1000 and y is about 1 to 500, more preferably x is about 5 to 20 and y is about 5 to 20. The reverse block copolymer surfactants can be straight chain or branched.

The reverse block copolymer can have any desired number of blocks. A preferred three-block copolymer can be represented by the general formula:

$$(PO)_y—(EO)_x—(PO)_y \qquad \text{II}$$

wherein x is about 1 to 1000, preferably about 4 to 230; and y is about 1 to 500, preferably about 8 to 27. Such a copolymer can be prepared by using propylene glycol as an initiator and adding ethylene oxide and propylene oxide. The polyoxyalkylene blocks are added to both ends of the initiator to result in the block copolymers. In such a linear block copolymer, generally the central $(EO)_x$ contains the residue of the initiator and x represents the total number of EO on both sides of the initiator. Generally, the residue of the initiator is not shown in a formula such as II because it is insignificant in size and in contribution to the property of the molecule compared to the polyoxyalkylene block. Likewise, although the end block of the polyoxyalkylene block copolymer terminates in a —OH group, the end block is represented by $—(PO)_p$, $—(EO)_x$, $—(PO)_y$, and the like, without specifically showing the —OH at the end. Also, x, y, and z are statistical values representing the average number of monomer units in the blocks.

The reverse polyoxyalkylene block copolymer can have more than three blocks, an example of which is a five-block copolymer, represented by the general formula:

$$(PO)_z—(EO)_y—(PO)_x—(EO_y—(PO)_z \qquad \text{III}$$

wherein x is about 1 to 1000, preferably about 7 to 21; y is about 1 to 500, preferably about 10 to 20; and z is about 1 to 500, preferably about 5 to 20.

A chain of blocks may have an odd or even number of blocks. Also, in other embodiments, copolymers with more blocks, such as, six, seven, eight, and nine blocks, etc., may be used as long as the end polyoxyalkylene block is either $(PO)_p$ or $(BO)_b$.

As previously stated, the reverse $—(EO)_e—(PO)_p$ block copolymer can also have a branched structure having a trifunctional moiety T, which can be the residue of an initiator. The block copolymer is represented by the formula:

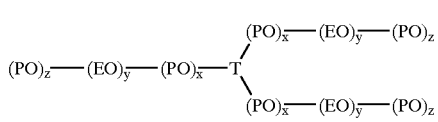

IV wherein x is about 0 to 500, preferably about 0 to 10; y is about 1 to 500, preferably about 5 to 12, and z is about 1 to 500, preferably about 5 to 10.

One example of trifunctional initiators that can produce such branched structures is triethanol amine, $N(CH_2CH_2OH)_3$, which results in a branched block $—(EO)_e—(PO)_p$ copolymer

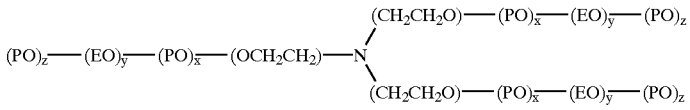

wherein x is about 0 to 500, preferably about 0 to 10; and y is about 1 to 500, preferably about 5 to 12; and z is about 1 to 500, preferably about 5 to 10.

Other appropriate multifunctional initiators, for example, triols, can be carbon-based. One example of a copolymer resulting from such an initiator is represented by the formula:

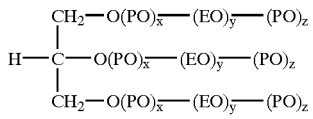

VI wherein the value of x is about 0 to 10, y is about 5 to 12, and z is about 5 to 10.

An example of a reverse block copolymer with four polyoxyalkylene arms is represented by the formula:

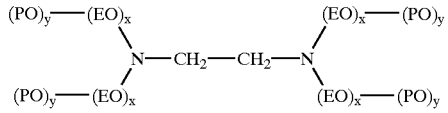

VII wherein x is about 1 to 500, preferably about 1 to 100; and y is about 1 to 500, preferably about 8 to 32.

The branches in multi-arm (or multi-branch) structures can each contain more than two blocks. Preferably, the end blocks are $—(PO)_p$ blocks or $—(PO)_p—R$, wherein R is a $C_{1-12}$ (lower) alkyl or a $—(BO)_b$ block with 1–5 moles of butylene oxide. Methods of making such polyoxyalkylene copolymers are known in the art and many such chemicals are commercially available (for example, TETRONIC R series from BASF Wyandotte Corporation). Table 2 shows exemplary reverse $(EO)_e—(PO)_p$ block. The block copolymers provided in Table 2 have an ethylene oxide content of less than about 50 wt-% of the copolymer.

TABLE 2

| Designation | —(EO)$_c$—(PO)$_p$ Block Copolymers Evaluated Structure |
|---|---|
| Polymer-1 | (PO)$_{9.5}$—(EO)$_{13}$—(PO)$_{12.5}$—(EO)$_{13}$—(PO)$_{9.5}$ |
| Polymer-2 | (PO)$_{13}$—(EO)$_{16.5}$—(PO)$_{12.5}$—(EO)$_{16.5}$—(PO)$_{13}$ |
| Polymer-3 | (PO)$_{25.5}$—(EO)$_{35}$—(PO)$_{25.5}$ |
| TETRONIC 90R4 | 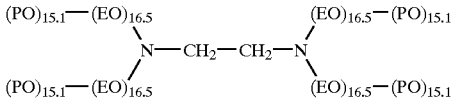 |
| TETRONIC 50R4 | 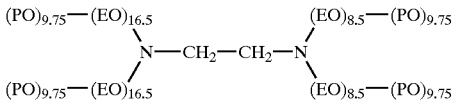 |
| GENAPOL PN30 | 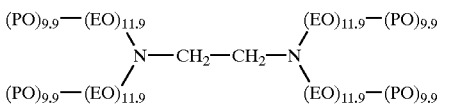 |
| PLURONIC 25R2 | (PO)$_{21.6}$—(EO)$_{14.2}$—(PO)$_{21.6}$ |
| PLURONIC L10 | (PO)$_{10}$—(EO)$_{11}$—(PO)$_{16}$—(EO)$_{11}$—(PO)$_{10}$ |
| Polymer-9 | $C_4H_9$—(PO)$_{5.3}$—(EO)$_{10.7}$—(PO)$_{20.7}$—(EO)$_{10.7}$—(PO)$_{5.3}$—$C_4H_9$ |
| Polymer-10 | 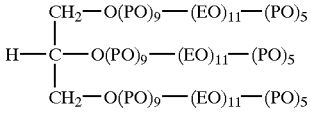 |
| Polymer-11 | (PO)$_{11}$—(EO)$_{11}$—(PO)$_7$—(EO)$_{11}$—(PO)$_{11}$ |

TETRONIC 90R4, TETRONIC 50R4, PLURONIC 25R2, and PLURONIC L10 can be obtained from BASF Wyandotte Corporation. GENAPOL PN30 can be obtained from Hoechst Celanese Corporation.

Although examples of reverse (EO)$_e$—(PO)$_p$ block copolymer (i.e., —(EO)$_e$—(PO)$_p$ block copolymers) are specifically described, other polyoxyalkylene block copolymers, such as —(EO)$_e$—(BO)$_b$ and (EO)$_e$—(PO)$_p$—(BO)$_b$ block copolymers, and the like, can be applied in a similar manner as the —(EO)$_e$—(PO)$_p$ block copolymers. In such cases, the (BO)$_p$ blocks can take the place of some of the (PO)$_p$ blocks in the —(EO)$_e$—(PO)$_p$ block copolymers. It is understood that one skilled in the art can modify an organic compound with (EO)$_e$, (PO)$_p$, and (BO)$_b$ moieties in a way to obtain substances not specifically disclosed in the embodiments of the present invention to accomplish essentially the same function in the same way as the invention to attain low-foaming and compatibility with thermoplastics such as polycarbonate and polysulfone.

The detergent composition preferably includes an amount of reverse polyoxyalkylene copolymer surfactant that provides a desired level of cleaning. In general, too much reverse polyoxyalkylene copolymer surfactant increases cost. Preferably, the amount of reverse polyoxyalkylene copolymer surfactant provided in the detergent composition concentrate is between about 0.01 wt. % and about 10 wt. %, and more preferably between 0.1 wt. % and 5 wt. %, and, even more preferably, between 0.5 wt. % and 1 wt. %.

Another surfactant that can be used in place of the reverse polyoxyalkylene copolymer surfactant or in combination with the reverse polyoxyalkylene copolymer surfactant is an alcohol alkoxylate surfactant with polyoxypropylene (PO)$_x$ and/or polyoxybutylene (BO)$_y$ end groups or end blocks wherein x is about 1 to 1000 and y is about 1 to 500. The alcohol alkoxylate surfactant with polyoxypropylene and/or polyoxypropylene end group can be referred to as a polyoxyalkylene alcohol alkoxylate surfactant. The alcohol alkoxylate surfactant can be provided in the amount identified above.

Cationic Surfactants

The cationic surfactants that can be used in the detergent composition include alkoxylated cationic ammonium surfactants. Preferred alkoxylated cationic ammonium surfactants have the following general formula:

VIII

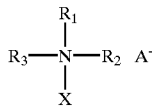

wherein A$^-$ represents a counter anion such as chloride, acetate, or phosphate, $R_1$, $R_2$, $R_3$, independently of each other, represent alkyl groups each containing 1–4 carbon atoms, and X represents —(PO)$_m$ or —(PO)$_m$ (EO)$_n$ or —(EO)$_n$ (PO)$_m$, wherein m is a number that ranges from about 1 to about 100, preferably 5 to 50, and n is a number that ranges from about 0 to about 50, preferably 5 to 50, and m+n is preferably from about 1 to about 100, and more preferably 5 to 50. Preferably, A$^-$ is acetate, $R_1$ is a methyl group, $R_2$ and $R_3$ are ethyl groups, and X is a polyoxypropylene group having between 5 and 50 repeating units.

The detergent composition preferably includes an amount of the cationic surfactant that provides a desired level of detergency. Too much cationic surfactant tends to increase the cost of the detergent composition. Preferably, the detergent composition concentrate according to the invention includes a cationic surfactant in an amount of between about 0.01 wt. % and about 10 wt. %, preferably between 0.1 wt. % and 3 wt. %, and, more preferably, between 0.3 wt. % and 0.8 wt. %.

Silicone Surfactants

The silicone surfactant that can be used in the detergent composition according to the invention preferably includes a polysiloxane hydrophobic group modified with one or more pendant hydrophilic polyalkylene oxide groups. Such silicone surfactants provide a detergent use composition having low surface tension, high wetting, antifoaming and stain removal. The silicone surfactant can be advantageously used in a detergent composition with the first surfactant for reducing the surface tension of the aqueous solutions, or use solution, to less than about 35 dynes/cm, and preferably between about 35 and about 15 dynes/cm, and more preferably between about 30 and about 15 dynes/cm. It should be appreciated that the detergent composition use solution has a measurable surface tension. In general, this means that the surface does not hydrophobicize to an extent that would provide an inaccurate or unmeasurable surface tension value. Preferably, the surface tension can be measured using the Wilhemy plate method. The silicone surfactants that can be used according to the invention are preferably nonionic or ionic (i.e., amphoteric).

Preferred silicone surfactants that can be used according to the invention can be characterized as polydialkyl siloxanes, preferably polydimethyl siloxanes to which hydrophilic group(s), such as polyethylene oxide, have been grafted through a hydrosilation reaction. The process results in an alkyl pendent (AP type) copolymer, in which the hydrophilic groups are attached along the siloxane backbone through a series of hydrolytically stable Si—C bond. The modified polydialkyl siloxane surfactants can have the following generic formulae:

IX

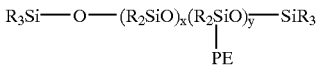

X

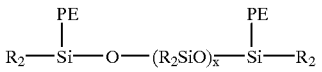

wherein PE represents a nonionic group, preferably $—CH_2—(CH_2)_p—O—(EO)_m(PO)_n—Z$, EO representing ethylene oxide, PO representing propylene oxide, x is a number that ranges from about 0 to about 100, y is a number that ranges from about 1 to 100, m, n and p are numbers that range from about 0 to about 50, $m+n \geqq 1$ and Z represents hydrogen or R wherein each R independently represents a lower ($C_{1-6}$) straight or branched alkyl. Preferably, p is a number from 0 to 6, and R is methyl.

Preferred silicone surfactants have the formula:

XI

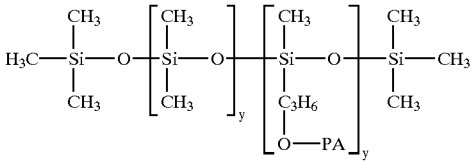

PA = $—(C_2H_4O)_a(C_3H_6O)_bR$ or

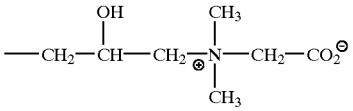

wherein x represent a number that ranges from about 0 to about 100, y represent a number that ranges from about 1 to about 100, a and b represent numbers that independently range from about 0 to about 60, $a+b \geqq 1$, and each R is independently H or a lower straight or branched ($C_{1-6}$) alkyl. A preferred silicone surfactant having formula XI includes x+y of about 24 to about 30, y of about 4 to about 7, the ratio of a/b being about 0.25, R being H, PA having a molecular weight of between about 800 and about 950, and the silicone surfactant having a molecular weight of between about 5,500 and about 6,500. A preferred silicone surfactant satisfying this criteria is available under the name ABIL® B 8852. A preferred silicone betaine surfactant is provided where x+y is about 16 to about 21, y is about 4 to about 7, and the molecular weight of the silicone betaine surfactant is between about 2,000 and 3,000. A silicone surfactant generally satisfying this criteria is available under the name ABIL® B 9950. Preferred silicone surfactants according to Formula XI include at least one of the following: y is less than 9, more preferably between 2 and 8; x is 0 to 90, more preferably 1 to 90; a is 1 to 60, more preferably 1 to 40, and, alternatively, 1 to 15 or 20 to 30; and b is 1 to 60, more preferably, 1 to 40, and, alternatively, 1 to 14 or 20 to 30.

Preferred silicone surfactants are sold under the SILWET® trademark or under the ABIL® B trademark. One preferred silicone surfactant, SILWET® L77, has the formula:

$$(CH_3)_3Si—O(CH_3)Si(R^1)O—Si(CH_3)_3 \quad \text{XII}$$

wherein $R^1$ is $—CH_2CH_2CH_2—O—(CH_2CH_2O)_zCH_3$ and wherein z is 4 to 16 preferably 4 to 12, most preferably 7–9.

Another class of silicone surfactants is an end-blocked (AEB type). Preferred AEB type silicone surfactants have the following general formula:

XIII

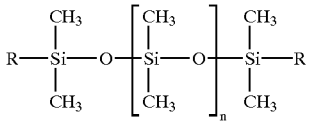

$R=—(CH_2)_3—O—(C_2H_4O)_x(C_3H_6O)_y—H$ wherein x represents 0 to 100, y represents 1 to 100, x+y represent 1 to 200.

The detergent composition includes an amount of silicone surfactant to provide a desired level of detergency. If the detergent composition is to be used in a warewashing machine, it is desirable to provide a sufficient amount silicone surfactant to reduce foaming when foaming is undesirable. If the composition is not to be used in a warewashing machine and foaming is not a particular concern, the maximum amount of silicone surfactant provided in the detergent composition is generally a function of cost. The detergent composition concentrate preferably includes an amount of silicone surfactant that is between about 0.01 wt. % and about 20 wt. %, preferably between 0.1 wt. % and 10 wt. %, and, more preferably, between 0.5 wt. % and 3 wt. %.

Anionic Surfactants

The anionic surfactants that can be used in the detergent composition include those surfactants that disperse particulates and provide desired cleaning properties. Preferred anionic surfactants are those that tend not to form insoluble complexes with calcium and magnesium. It should be appreciated that anionic surfactants that do form insoluble complexes with calcium and magnesium can be used in the detergent composition, but when such anionic surfactants are used it is generally desirable to provide a chelating agent to handle calcium and magnesium that may be present. The incorporation of a chelating agent tends to increase the expense of the detergent composition and detracts from the amount of other surfactant components that can be incorporated into the detergent composition. In addition, the anionic surfactant is preferably one that does not generate too much foaming if the detergent composition is intended to be used in a warewashing machine.

Preferred anionic surfactants that can be used according to the invention include sulfates, sulfonates, and carboxylates.

Preferred sulfate surfactants include alkyl sulfates and alkylether sulfates wherein the alkyl group includes between about 6 and 18 carbon atoms, and more preferably between about 12 and 14 carbon atoms. Particularly preferred sulfates include lauryl sulfate and laurylether sulfate.

Sulfonate surfactants that can be used in the detergent composition include monosulfonates and disulfonates. Particularly preferred sulfonates include alkyl benzene sulfonates, alkyl sulfonates, alkyl diphenylene oxide disulfonates, and alphaolefin sulfonates, wherein the alkyl group contains between about 6 and 18 carbon atoms, and more preferably between about 12 and 14 carbon atoms.

Preferred alkyl benzene sulfonate surfactants have the following formula:

XIV

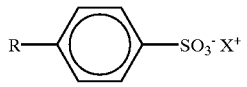

wherein R is an alkyl group having 6 to 18 carbon atoms (preferably 12 to 14 carbon atoms) and $X^+$ is a counter ion. Preferred counter ions include sodium, potassium, and magnesium. The alkyl benzene sulfonates can be linear or branched. Linear alkyl benzene sulfonates are preferred because they are more biodegradable than the branched alkyl benzene sulfonates.

Preferred alkyl sulfonates have the following formula:

$$R—SO_3^-X^+ \quad \text{XV}$$

wherein R is an alkyl group having 6 to 18 carbon atoms (preferably 12 to 14 carbon atoms) and X is a counter ion. Preferred counter ions include sodium, potassium, and magnesium. The alkyl group can be linear or branched.

Preferred alkyl diphenylene oxide disulfonate have the following formula:

XVI

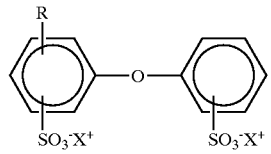

wherein R is an alkyl group having 4 to 18 carbon atoms (preferably 6 to 12 carbon atoms) and $X^+$ is a counter ion. Preferred counter ions include sodium, potassium, and magnesium. The alkyl group can be linear or branched. An alkyl diphenylene oxide disulfonate having an alkyl group with 6 carbon atoms is available under the name Dowfax Hydrotope from Dow Chemical.

Alphaolefin sulfonates have the following formula:

$$CH_3(CH_2)_n—C{=}CH—CH_2—SO_3^-X^+ \quad \text{XVII}$$

wherein n is 6 to 20 and $X^+$ is a counter ion and is preferably sodium, potassium, or magnesium.

Carboxylates that can be used according to the invention include alcohol ethoxy carboxylates having the formula:

XVIII

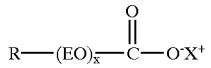

wherein R is an alkyl or alkyl benzene group having 8 to 18 carbon atoms, x is a number ranging from 1 to 20 and preferably 2 to 10, and $X^+$ is a counter ion and is preferably sodium, potassium, or magnesium.

The detergent composition preferably includes an amount of the anionic surfactant that provides a desired level of detergency. If the detergent composition is to be used in a warewashing machine, it is desirable to limit the amount of anionic surfactant to an amount that does not result in an undesirable amount of foaming. If the detergent composition is not to be used in a warewashing machine, the maximum amount of anionic surfactant can be determined by cost. Preferably, the detergent composition concentrate according to the invention includes a anionic surfactant in an amount of between about 0.01 wt. % and about 10 wt. %, preferably between 0.1 wt. % and 3 wt. %, and, more preferably, between 0.3 wt. % and 0.8 wt. %.

In a preferred detergent composition according to the invention, the weight ratio of combined reverse polyoxyalkylene copolymer surfactant and silicone surfactant to combined alkyl polyglycoside surfactant and anionic surfactant is between about 5:1 and about 1:1.

Additional Components

Optional ingredients can be included to facilitate the east of utilization of the detergent composition. For example, "KATHON CG/ICP" is a preservative effective for preserving APGs against microbial attack; "SAP GREEN" is a green dye; and SXS, DOWFAX 3B2, PETRO 22, NAS-8D, PETRO AA, and PETRO LBA are all commercially available anionic hydrotropes. Such anionic hydrotropes are useful for maintaining product stability and preventing phase separation over time. These anionic hydrotropes have been found to be "neutral" to plastics in that they do not protect or damage plastics. When the formulated detergent compositions are diluted to the concentration typically used for rinsing ware, the optional ingredients are diluted to such a low concentration that they no longer perform any significant function.

Chelating agents can be incorporated into the detergent composition according to the invention, when desired. Chelating agents that can be used according to the invention are those that are conventionally used in the detergent industry. Exemplary chelating agents include amino carboxylates. Exemplary amino carboxylates include nitrilotriacetic acid (NTA), ethylene diamine, tetra-acetic acid (EDTA), and diethylene triamine penta-acetic acid (DTPA). In addition, builders that can be used according to the invention are those builders that are conventional in the detergent industry. It should be appreciated that chelating agents and builders are desirable to protect the anionic surfactant. Accordingly, the amount of anionic surfactant is preferably provided so that the weight ratio of anionic surfactant to builder is between about 1:5 and about 5:1 and preferably about 1:1 based upon the anionic surfactant and the builder having the same active level.

The detergent composition can be applied to an article as a concentrate or it can be further diluted with water. Preferably, the detergent composition is applied to the article surface that is a plastics material in need of cleaning to provide a soak time or residence time that allows the detergent composition to interact with the soil provided on the surface of the article. Preferably, the soak time or residence time is sufficient to allow the detergent composition to provide a desired level of cleaning. In addition, the detergent composition should be sufficiently active so that the cleaning time is not too long. Preferably, the soak time or residence time is at least about 10 seconds, and more preferably between about one minute and about ten minutes, and, more preferably, between about one minute and about five minutes. In the case of relatively large articles such as playground equipment, the detergent composition can be rinsed from the article. In the case of smaller articles such as helmets, the article can be placed in a warewashing machine and washed during a conventional wash cycle. A preferred rinse agent for rinsing the article is water. The detergent composition is preferably applied to an article by spraying onto the article surface. The articles can then be rinsed or placed in a warewashing machine for further washing and/or rinsing. Furthermore, the articles can be cleaned by placing the articles in a warewashing machine and washing by applying the detergent composition in the warewashing machine. When the detergent composition is applied in a warewashing machine, it is expected that the use solution will be more dilute.

During the cleaning of the article surface, it is preferable that the article is not too hot or exposed to a use solution that is too hot. Preferably, the detergent composition used to clean the article surface is provided at a temperature of between about 50° F. and about 170° F., more preferably between 85° F. and 140° F., and even more preferably between 100° F. and 120° F. In addition, it is preferred that the rinse solution is provided within these temperature ranges. It is expected that if the temperature of the use solution or the rinse solution is too hot, it may cause stress cracking in the article.

Preferred techniques for cleaning an article surface include at least one of the following: (a) applying the detergent composition to the article and then either rinsing the detergent composition from the article outside of a warewashing machine or rinsing the detergent composition from the article utilizing a wash and/or rinse cycle in a warewashing machine, and with or without the addition of further detergent composition inside the warewashing machine; and (b) placing an article within a warewashing machine and applying detergent composition to the article within the warewashing machine and rinsing the article within the warewashing machine.

It is preferable that the detergent composition is relatively plastic safe. That is, an article can be washed multiple times without developing observable stress cracking. Preferably, the article can be washed at least ten times, and even more preferably at least 25 times, without developing observable stress cracking. In contrast, it is expected that caustic based cleaning solutions having a pH of 12 or higher will have a greater tendency to cause stress cracking in articles manufactured from polycarbonate polymers, acrilonitrile-butadiene-styrene polymers, and polysulfone polymers. The detergent composition according to the invention preferably provides a use solution having a pH of between about 5 and about 8.

When the detergent composition is applied directly to the plastics material to be cleaned, the detergent composition preferably has a viscosity which allows it to be applied to the plastics material via spray application, and which will then stay in contact with the plastics material. Preferably, the viscosity of the detergent composition is between about 200 and about 800 centipoise, more preferably between about 250 and 700 centipoise, and even more preferably between 300 and 600 centipoise. The viscosity can be measured using a Brookfield viscometer having a number 2 spindle and operated at 0.5 rpm.

The detergent composition that can be applied to plastics material by spray application preferably has the weight percent of components identified in Table 3. It should be understood that the weight percent of each component is expressed based upon 100% active for each active component. Components having an active level of less than 100% can be used although the amount expressed in Table 2 is based upon a 100% active level.

TABLE 3

| Component | Range (wt. %) | Preferred Range (wt. %) | More Preferred Range (wt. %) |
|---|---|---|---|
| anionic surfactant | 0.01–10 | 0.1–3 | 0.3–0.8 |
| cationic surfactant | 0.01–10 | 0.1–3 | 0.3–0.8 |

TABLE 3-continued

| Component | Range (wt. %) | Preferred Range (wt. %) | More Preferred Range (wt. %) |
|---|---|---|---|
| reverse polyoxyalkylene copolymer surfactant | 0.01–10 | 0.1–5 | 0.5–1 |
| alkyl polyglycoside surfactant | 0.01–10 | 0.1–3 | 0.1–0.6 |
| silicone surfactant | 0.01–20 | 0.1–10 | 0.5–3 |
| builder/chelating agent/sequestrant | 0–10 | 0.5–6 | 1–4 |
| other (water, thickener, dye, fragrance) | balance | balance | balance |

The concentration identified in Table 3 can be further diluted or not further diluted to provide a use solution that is applied to the article surface. A preferred diluent includes water. For a use solution applied directly to an article surface outside of a warewashing machine environment, it is expected that the use solution will have an active concentration of between about 2 wt. % and about 10 wt. %, and, more preferably, between about 6 wt. % and about 9 wt. %. In addition, it is expected that the active concentration of the use solution used in a warewashing machine will be between about 0.005 wt. % and about 3 wt. %, and, more preferably, between about 0.02 wt. % and about 1 wt. %. It should be understood that the active concentration refers to the concentration of surfactants, builder, chelating agents, and sequestrants provided in the use solution. The active concentration generally excludes water, thickeners, dyes, and fragrances. In addition, it should be understood that when the detergent composition is applied to an article surface in a warewashing machine, it is expected that a relatively high concentrate of the detergent composition will be fed to the warewashing machine, and that the warewashing machine will dilute the detergent composition with water to provide the use solution that is applied to the article surface.

A preferred detergent composition is provided in Table 4 where the active level of each component is 100% unless specifically indicated to the contrary.

TABLE 4

| Percent | Raw Material |
|---|---|
| 91.675 | Water, Zeolite softened |
| 0.840 | EP PO Polymer; D-097 |
| 0.280 | Lauryl Polyglucose 50% |
| 0.400 | Dowfax C6L |
| 1.000 | Polyether Siloxane; Abil B 8852 |
| 0.500 | Linear Dodecyl Benzene Sulfonic Acid 97% |
| 2.000 | Tetrasodium EDTA Liq. 40% |
| 0.500 | Propoxylated Quaternary Ammonium Chloride |
| 2.500 | Acusol 820 Thickener |
| 0.300 | Potassium Hydroxide, 45% Liquid |
| 0.005 | Sandolan Blue E-HRL 100%, Acid Blue 182 |

The above specification provides a complete description of the manufacture and use of the composition of the invention. Since many embodiments of the invention can be made without departing from the spirit and scope of the invention, the invention resides in the claims hereinafter appended.

We claim:

1. A plastics compatible detergent composition comprising:

(a) an effective amount of an anionic surfactant to provide detergency;

(b) an effective amount of cationic surfactant to provide detergency;

(c) an effective amount of at least one of polyoxyalkylene block copolymer surfactant containing polyoxypropylene and/or polyoxybutylene end groups, alcohol alkoxylate surfactant having polyoxypropylene end groups, alcohol alkoxylate surfactant having polyoxybutylene end groups, alcohol alkoxylate surfactant having polyoxypropylene and polyoxybutylene end groups, and mixtures thereof;

(d) an effective amount of alkyl polyglycoside surfactant to provide cleaning; and (e) an effective amount of silicone surfactant to provide detergency.

2. A plastics compatible detergent composition according to claim 1, wherein the anionic surfactant comprises at least one of sulfate, sulfonates, and carboxylate.

3. A plastics compatible detergent composition according to claim 1, wherein the anionic surfactant comprises alkyl diphenylene oxide disulfonate having the formula:

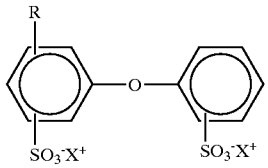

wherein R is an alkyl group having 6 to 18 carbon atoms and X+ is counter ion.

4. A plastics compatible detergent composition according to claim 1, wherein the anionic surfactant comprises at least one of lauryl sulfate and lauryl ether sulfate.

5. A plastics compatible detergent composition according to claim 1, wherein the cationic surfactant comprises an alkoxylated cationic ammonium surfactant having the formula:

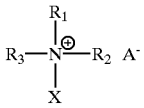

wherein A represents a counter anion, $R_1$, $R_2$, and $R_3$, independently of each other, are alkyl groups of 1–4 carbon atoms, and X is $—(PO)_m$ or $—(PO)_m(EO)_n$ or $—(EO)_n(PO)_m$ wherein m is about 1 to about 100 and n is about 0 to about 50.

6. A plastics compatible detergent composition according to claim 5, wherein the counter anion is at least one of chloride, acetate, and phosphate.

7. A plastics compatible detergent composition according to claim 1, wherein the polyoxyalkylene block copolymer surfactant having polyoxypropylene and/or polyoxybutylene end groups comprises a polyoxyethylene-polyoxypropylene block copolymer.

8. A plastics compatible detergent composition according to claim 1, wherein the alkyl polyglycoside surfactant comprises a surfactant having the formula:

$$G_x—O—R$$

wherein G is moiety drive from reducing saccharide containing 5 or 6 carbon atoms, R is a fatty aliphatic group containing 6 to 20 carbon atoms, and x is less than 2.5.

9. A plastics compatible detergent composition according to claim 1, wherein the silicone surfactant has the following formula:

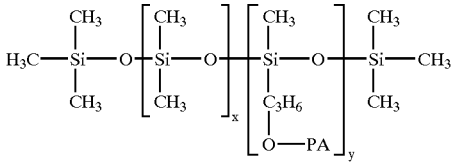

PA = $—(C_2H_4O)_a(C_3H_6O)_bR$ or

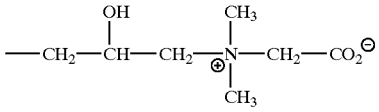

wherein x is a number ranging from 0 to 100, y is a number from 1 to 100, a and b are numbers that independently are 0 to 60 with the proviso that a+b is greater than or equal to 1, and each R is independently H or lower straight or branched $C_{1-6}$ alkyl group.

10. A plastics compatible detergent composition according to claim 1, wherein the anionic surfactant comprises a sulfate surfactant having an alkyl group containing between 6 and 18 carbon atoms.

11. A plastics compatible detergent composition according to claim 10, wherein the sulfate surfactant comprises at least one of lauryl sulfate and lauryl ether sulfate.

12. A plastics compatible detergent composition according to claim 1, wherein the anionic surfactant comprises an alkyl benzene sulfonate surfactant having the formula:

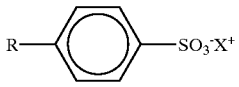

wherein R is an alkyl group having 6 to 18 carbon atoms and $X^+$is a counter ion.

13. A plastics compatible detergent composition according to claim 1, wherein the anionic surfactant comprises an alkyl sulfonate having the formula:

$$R—SO_3^-X^+$$

wherein R is an alkyl group having 6 to 18 carbon atoms and $X^+$is a counter ion.

14. A plastics compatible detergent composition according to claim 1, wherein the anionic surfactant comprises a carboxylate having the formula:

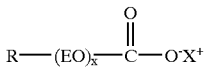

wherein R is an alkyl or alkyl benzene group having 8 to 18 carbon atoms, x is a number ranging from 1 to 20, and X+ is a counter ion.

15. A method for washing an article having a plastic surface, the method comprising steps of:

(a) applying a detergent composition to the plastic surface, the detergent composition comprising:

(i) an effective amount of an anionic surfactant to provide detergency;

(ii) an effective amount of cationic surfactant to provide detergency;

(iii) an effective amount of at least one of polyoxyalkylene block copolymer surfactant containing polyoxypropylene and/or polyoxybutylene end groups, alcohol alkoxylate surfactant having polyoxypropylene end groups, alcohol alkoxylate surfactant having polyoxybutylene end groups, alcohol alkoxylate surfactant having polyoxypropylene and polyoxybutylene end groups, and mixtures thereof;

(iv) an effective amount of alkyl polyglycoside surfactant to provide cleaning;

(v) an effective amount of silicone surfactant to provide detergency; and (b) rinsing the detergent composition from the article.

16. A method according to claim 15, wherein the plastic surface comprises at least one of polycarbonates polymers, acrilonitrile-butadiene-styrene polymers, and polysulfone polymers.

17. A method according to claim 15, wherein the step of applying comprises providing the detergent composition with a residence time on the plastic surface of between about 10 seconds and about 10 minutes.

18. A method according to claim 15, further comprising a step of:

(a) rinsing the article in a warewashing machine.

19. A method according to claim 15, wherein the detergent composition has a viscosity between about 200 cps and about 800 cps measured using a Brookfield viscometer having a number 2 spindle and operated at 5 rpm.

20. A method according to claim 15, wherein the detergent composition has an active concentration of between about 2 wt. % and about 10 wt. %.

21. A method according to claim 15, wherein the step of applying a detergent composition to the plastic surface further comprises diluting the detergent composition to provide a use solution having an active concentration of between about 0.005 and about 3 wt %.

22. A method according to claim 21, wherein the use solution is applied to the plastic surface inside a warewashing machine.

23. A method according to claim 15, wherein the detergent composition has a pH of between about 5 and about 8.

* * * * *